United States Patent [19]

Oswald

[11] 4,403,471

[45] Sep. 13, 1983

[54] BOBBIN EXCHANGE APPARATUS ON A RING SPINNING OR RING TWISTING MACHINE

[75] Inventor: Peter Oswald, Matzingen, Switzerland

[73] Assignee: Rieter Machine Works Limited, Winterthur, Switzerland

[21] Appl. No.: 295,837

[22] Filed: Aug. 24, 1981

[30] Foreign Application Priority Data

Sep. 15, 1980 [CH] Switzerland ..... 6901/80

[51] Int. Cl.[3] ..... D01H 9/08; D01H 9/14

[52] U.S. Cl. ..... 57/274; 57/276; 198/646; 198/836

[58] Field of Search ..... 57/266, 268, 270, 273–276; 198/645–653, 692, 831, 836, 839

[56] References Cited

U.S. PATENT DOCUMENTS 3,370,411 2/1968 Schulz et al. ..... 57/274

3,398,519 8/1968 Haussmann ..... 57/274

*Primary Examiner*—John Petrakes

*Attorney, Agent, or Firm*—Werner W. Kleeman

[57] ABSTRACT

A bobbin exchange apparatus on a ring spinning or a ring twisting machine contains a transporting belt extending substantially horizontally in the longitudinal direction of the machine. The transporting belt is provided with bobbin holders and, viewed relative to the machine, is inclined downward towards the front. According to the invention, there are provided supporting means extending in the longitudinal direction of the machine. These supporting means are contacted by the front side of the empty bobbin tubes placed onto the transporting belt. The invention permits a considerable space saving to be achieved in such a manner that, in comparison to known machines, more space is available for the spindle bearings or bolsters and there can be used a spindle rail which fulfils the requirements of sufficient stability. Furthermore, the invention allows an improved spinning geometry to be chosen.

13 Claims, 4 Drawing Figures

Fig. 2
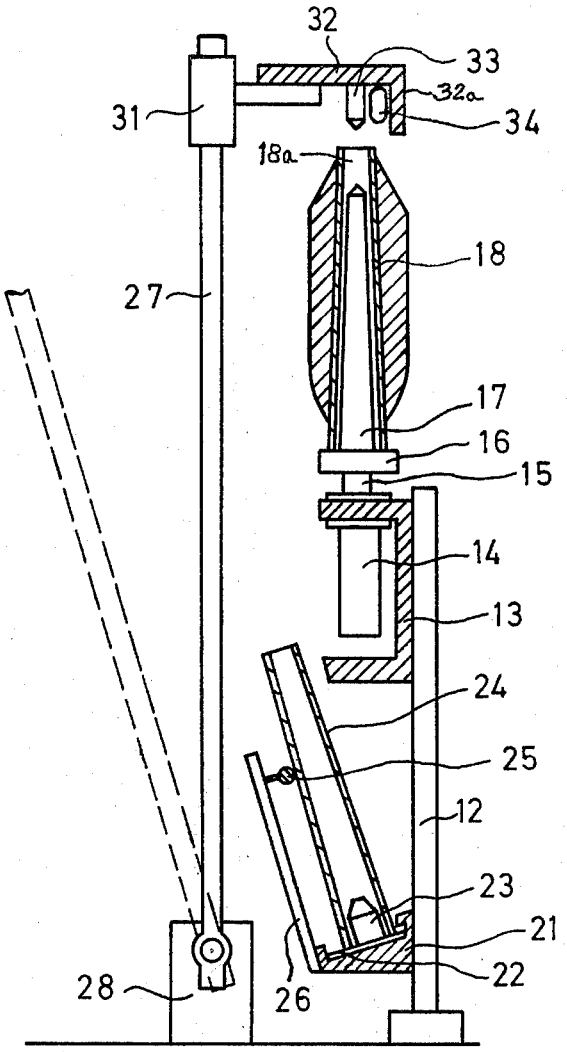
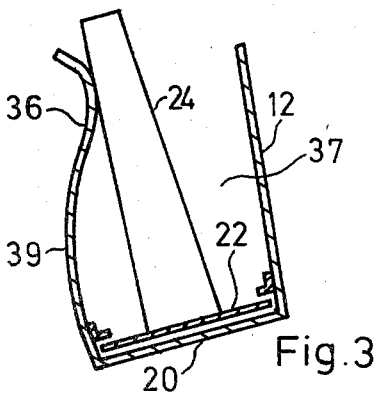
Fig. 3
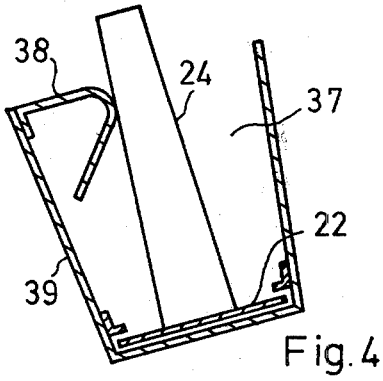
Fig. 4

BOBBIN EXCHANGE APPARATUS ON A RING SPINNING OR RING TWISTING MACHINE

BACKGROUND OF THE INVENTION

The present invention relates to a new and improved bobbin exchange apparatus on a ring spinning or ring twisting machine.

Generally speaking, the bobbin exchange apparatus of the present invention is of the type comprising a transporting belt which is provided with a plurality of bobbin holders for taking-up or receiving bobbin tubes. The mutual distance or spacing of the bobbin holders is equal to the spindle gauge, and the transporting belt extends substantially horizontally in the longitudinal direction of the machine.

On ring spinning and ring twisting machines spun yarns or twisted threads, respectively, are simultaneously wound onto a plurality of bobbin tubes placed onto spindles using a ring and traveller system. After the bobbin packages have been wound to completion, they are exchanged for empty bobin tubes. On a machine this bobbin exchange operation is simultaneously effected for all bobbin tubes. According to Austrian Patent No. 271,278 and the corresponding U.S. Pat. No. 3,370,411 a doffer beam is provided for this purpose. Such beam is equipped with a gripper for each of the bobbin tubes to be exchanged. By performing appropriate movements of the doffer beam along the columns which support it, and by suitably pivoting the latter, the full bobbin packages are transferred onto a transporting belt from which empty bobbin tubes are removed and are then donned onto the spindles.

This type of bobbin tube exchange is associated with the disadvantage that on the machine a relatively large amount of space is required between the spindle bearings or bolsters and the transporting belt. As a result, the spindle bolsters cannot be designed with the length required. And on the other hand, the spindle rails have to be designed to possess reduced dimensions which, in turn, impairs their stability.

According to a bobbin exchange device as is known from Swiss Patent No. 611,351, the transporting belt which is simultaneously pivoted with the doffer beam, which is used for exchanging the bobbin tubes, is pivoted through the same angle. Thus, no vertical movements of the doffer beam towards the transporting belt and away from it are required for taking-up or receiving the empty tubes and for placing the full bobbin package tubes. The bobbin exchange can be accomplished with a movement forming an acute angle with respect to the vertical direction. Thus, a certain saving in space is realized in comparison to the first-mentioned bobbin exchange device, since here the doffer beam no longer is required to be moved in the space available between the bobbin tubes placed on the transporting belt and the spindle bearing housings. However, also according to this second mentioned patent, the spinning machine cannot be equipped with a profile of the spindle rail which provides great stability, nor can optimum space utilization or good spinning geometry be attained.

The above-mentioned disadvantages are avoided on machines with such bobbin exchange devices known in practice in advantageous manner, when the transporting belt is arranged, with respect to the machine, so as to be inclined towards the front. It has been found, however, that due to the inclined position of the transporting belt the situation can arise that the bobbin tubes which are retained on the transporting belt by the bobbin holders are not exactly held in the intended position.

It may particularly occur that the empty bobbin tubes, as concerns their inclined position, are not all inclined at exactly the same angle of inclination. Under these circumstances there is not ensured for a correct bobbin tube exchange operation. At this point it should be noted as concerns the discussed state of the art, particularly the device known from the abovementioned Swiss patent, due to the repeated pivoting or tilting of the transporting belt together with the doffer beam including the bobbin tubes placed on the transporting belt, this disadvantage also exists in this prior art equipment.

SUMMARY OF THE INVENTION

Therefore, with the foregoing in mind it is a primary object of the present invention to provide a new and improved construction of bobbin exchange apparatus on a ring spinning or ring twisting machine which is not associated with the aforementioned drawbacks and limitations of the prior art constructions discussed above.

Another and more specific object of the present invention is to provide a new and improved construction of bobbin exchange apparatus of the character described which is relatively simple in construction and design, extremely reliable in operation, not readily subject to breakdown or malfunction, and requires a minimum of maintenance and servicing.

Now in order to implement these and still further objects of the invention, which will become more readily apparent as the description proceeds, the bobbin exchange apparatus of the present development is manifested by the features that there are provided support means which extend substantially in the longitudinal direction of the machine. These support means are arranged in front of the bobbin tubes which are placed on the bobbin holders and act as a support for such bobbin tubes.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures there have been generally used the same reference characters to denote the same or analogous elements and wherein:

FIG. 2 is a cross-sectional view of the arrangement of FIG. 1, taken substantially along the line II—II thereof; and FIGS. 3 and 4 respectively show in cross-sectional view further embodiments of the invention and depicting the supporting or support means and their arrangement.

DETAILED DESCRIPTION OF THE PREFERRED EMBODIMENTS

Figure 1:
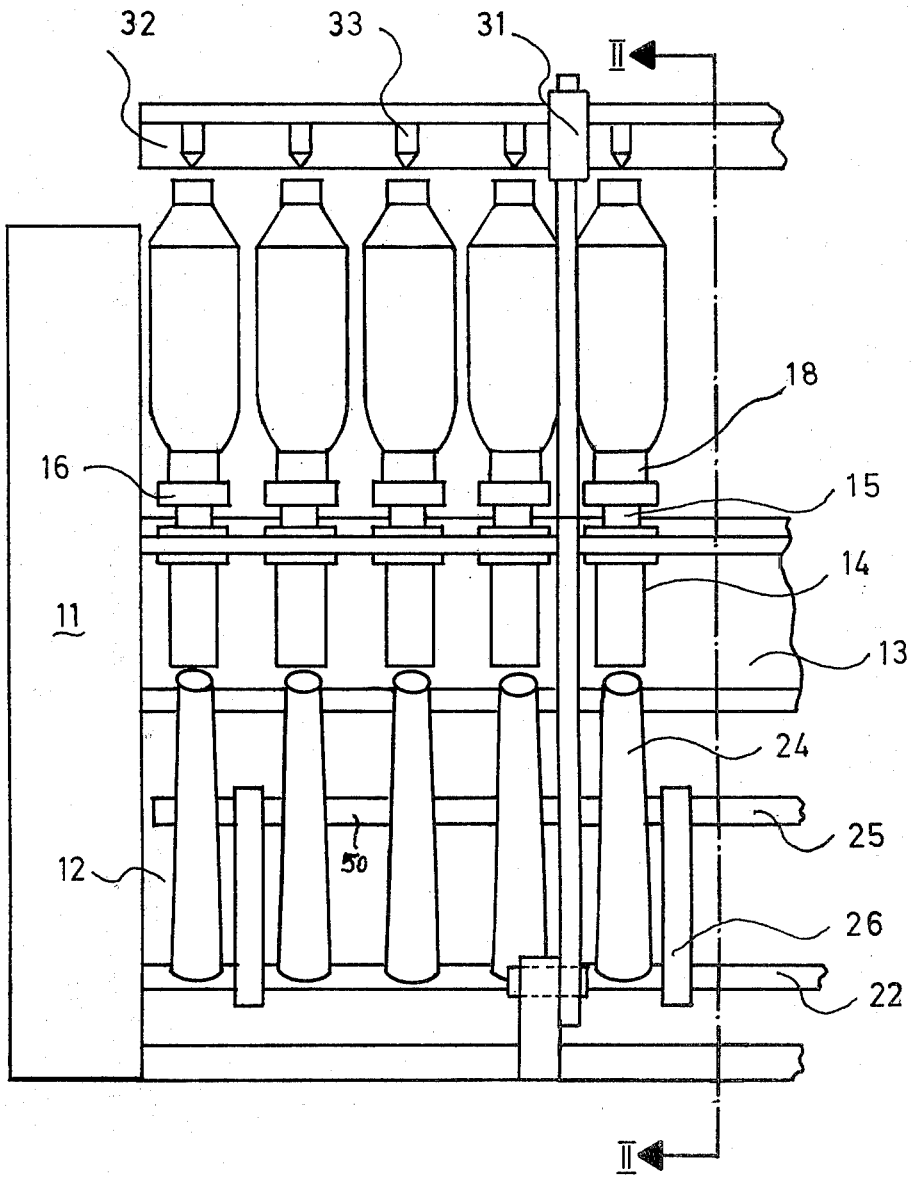
FIG. 1 is a front view depicting the left-hand side end of a ring spinning or ring twisting machine equipped with a bobbin exchange apparatus according to the invention.

Describing now the drawings, in FIGS. 1 and 2 the left-hand side wall is designated by reference numeral 11 and a back or rear wall of the machine frame by reference numeral 12. On the rear or back wall 12 there is mounted a spingle rail 13 which supports spindle bearings or bolsters 14 together with the bobbin spindles 15. The bobbin spindles 15 are driven by means of drive rolls or whorls 16 or equivalent drive means. Each bobbin spindle 15 is provided with a spindle upper portion or blade 17 (FIG. 2) and there is placed upon each spindle upper portion or blade 17 a bobbin tube 18. Onto the latter the spun yarns are wound during the operation of the machine.

Below the spindle rail 13 there is arranged a guide element or guide means 21 which is also mounted at the rear or back wall 12. To improve the clarity of the illustration this guide element 21 has not been shown in FIG. 1. This guide element 21 is used for guiding a transporting belt or band 22 upon which there are mounted bobbin holders 23. The mutual distance or gauge between neighbouring bobbin holders 23 is equal to the distance between neighbouring spindles 15, i.e. equal to the spindle gauge. Onto each of the bobbin holders 23 there is placed a bobbin tube 24. As shown in FIG. 2, the transporting belt 22 is held by the guide element 21 in a position, wherein the belt 22 is positioned, as viewed relative to the machine, at a downward inclination towards the front, i.e. in FIG. 2 towards the left.

A bar or rod 25 or equivalent structure, forming a support or supporting means, extends in the longitudinal direction of the spinning or twisting machine. It is fixed to rods 26 or the like arranged at a mutual spacing from one another and the bar or rod 25 is used for supporting the bobbin tubes 24. The rods 26, in turn, are mounted in any suitable fashion at the guide element 21.

Furthermore, there are provided individual support columns 27 which are distributed over the length of the machine. In the drawing only one of these support columns 27 is visible. This column 27, as well as the ones not shown, are pivotably supported in a base member 28. Each such support column 27 can be pivoted between the position shown in full or solid lines and the position indicated with broken lines. Each of the support columns 27 is provided with a support member 31. These support members 31 are elevationally movable along the support columns 27.

The support members 31 support a doffer or withdrawal beam 32 extending in the longitudinal direction of the machine. Upon the doffer beam 32 there are mounted pins 33 at a mutual distance or spacing from one another which is equal to the spindle gauge. The pins 33 are aligned in registry with the bores 18*a* of the bobbin tubes 18. A flexible and expansible hose 34 extends between the pins 33 and the vertical back or rear wall 32*a* of the doffer beam 32. Air or any other suitable fluid medium can be supplied to this hose 34 at a variable pressure. The doffer beam 32, together with its support members 31, can be moved up and down along the support columns 27.

In FIG. 3 there are shown a guide member 20 for a transporting belt or band 22 and a bobbin tube 24. An extended surface-like or area-type element 36 extending in the longitudinal direction of the machine (i.e. at right angles to the plane of the drawing) is here used as a supporting or support means which is contacted by the bobbin tubes 24. At the same time this extended support element or means 36 also forms the front wall 39 of a duct or channel 37 for the bobbins and bobbin tubes 24 and in which there is arranged the transporting belt 22.

If, during operation of the ring spinning or ring twisting machine, the bobbin tubes 18 are filled with yarn or thread or the like wound onto them, then they are doffed and replaced by empty bobbin tubes 24. For this purposes the pressure inside the hose or expansible element 34 is kept low, and the doffer beam 32 is lowered to such an extent that the pins 33 penetrate into the bores 18*a* of the full bobbins 18. In this position the hose 34 contacts the walls of the full bobbins 18. As the pressure inside the hose 34 is increased, the full bobbins 18 are held tightly between the hose 34 and the pins 33. As the doffer beam 32 is lifted, the full bobbins 18 are doffed from the spindle upper portions or blades 17, whereupon the support columns 27 are pivoted into their position indicated with broken or phantom lines. Thereafter, the doffer beam 32 is lowered to such an extent that the full bobbins 18 can be dropped onto the transporting belt 22. The transporting belt 22 previously has been positioned in its longitudinal direction in such a manner that the full bobbins 18 arrive at the spaces between the empty bobbin tubes 24.

For donning the empty bobbin tubes 24 upon the spindles 15, first the transporting belt or band 22 is shifted by half a spindle gauge. As the doffer beam 32 is lowered further, the pins 33 penetrate into the bores 18*a* of the empty bobbin tubes 24. The latter now are gripped and lifted in an operating manner corresponding to that described above and are brought into their working position on the spindle upper portions or blades 17. The full bobbins 18 are removed by the transporting belt 22.

From the showing of FIG. 2 it will be seen that the inclined position of the bobbin tubes 24 permits the distance between the guide element 21 or the transporting belt 22 respectively, and the spindle rail 13 to be kept small, and specifically in such a manner that in a zone, which is important for the operation of the machine, a saving in space is achieved. Furthermore, the spindle rail 13 can be designed to possess a substantially U-shaped cross-section by virtue of which its mechanical stability is increased quite considerably. The depicted inclination of the transporting belt 22 thus affords substantial advantages. It presents, however, also a disadvantage: if any of the bobbin tubes 24 for any reason, e.g. due to wear, no longer is accurately positioned by the bobbin holders 23, it may happen that due to the inclined position of the transporting belt 22, and thus, the bobbin tubes 24, the latter are inclined towards the front somewhat too far with respect to the correct or prescribed angle of inclination, and that one or another of the bobbin tubes during the bobbin tube exchange operation is no longer securely gripped by the elements 32, 33, 34.

This is intended to be avoided with the inventive embodiment according to FIGS. 1 and 2 by the provision of the bar or rod 25. The rod 25 or equivalent structure ensures that the inclination of the bobbin tubes 24 towards the front will exactly correspond to the desired angle of inclination. Positioning of the bobbin tubes 24 in the other directions, as a rule, does not present any difficulties, because they exactly contact the transporting belt 22 under the action of their own weight.

In FIG. 3 there has been shown a supporting means which is formed by the extended area-type or surface-like element 36 extending in the longitudinal direction of the machine. The cross-section of this extended element 36, i.e. its profile, is curved. With this shape there is imparted to the element 36 sufficient stability to ensure for the exact inclination of the bobbin tubes 24. The extended areal element 36 is mounted upon the guide element 20 for the transporting belt 22 and, as previously explained, forms the front wall 39 of the channel or duct 37 for the full bobbins 18 and bobbin tubes 24.

According to the embodiment of FIG. 4 the supporting means ensuring for the exact positioning of the bobbin tubes 24 is designed as an extended, area-type or surface-like element 38 containing a bowed or arc-shaped cross-section. The selection of a bowed or arc-shaped cross-section increases the stability of the extended support element 38. With this embodiment, the areal extended element 38 is secured to the channel or duct 37 for the bobbins 18 and bobbin tubes 24.

It is here to be mentioned that a given prescribed exactitude of the inclination of the bobbin tubes 24 is achieved using the means shown, in a more simple manner the closer there is the area of contact of the supporting means 25, 36 or 38 and the bobbin tubes 24 at the upper ends of such bobbin tubes 24.

Instead of a solid rod or bar 25 there also can be used a tube-like or hollow tubular rod as the supporting or support means. Instead of a circular cross-section of such rod there also can be selected e.g. an elliptic or a rectangular cross-section. In the case of a supporting means which, as shown in FIGS. 3 and 4, consists of an area-type or surface-like element extending substantially over the length of the machine, the cross-section is designed to possess a bowed, curved or angled configuration for attaining an increased stability of such element.

As shown in FIGS. 1 and 3, the supporting means can be mounted at the guide element of the transporing belt. It can, however, also be mounted directly at the machine frame.

The empty bobbin tubes 24 are placed onto the transporting belt on one side of the spinning or twisting machine. They are then transported and positioned by the transporting belt in such a manner that for exchanging them against full bobbins 18 they can be gripped by the doffer beam 32. During the movement of the transporting belt 22, onto which empty bobbin tubes 24 are placed, the empty bobbin tubes 24 contact the supporting means 25, 36 or 38. In order to prevent all possibilities of any deviation in the position of the empty tubes from their position which is at right angles with respect to the transporting belt 22 caused by the supporting means 25, 36, 38 such supporting means can be provided, at least at the points contacted by the bobbin tubes, with a low friction surface, as generally indicated by reference character 50 in FIG. 1.

While there are shown and described present preferred embodiments of the invention, it is to be distinctly understood that the invention is not limited thereto, but may otherwise variously be embodied and practiced within the scope of the following claims.

Accordingly what I claim is:

1. A bobbin exchange apparatus on a ring spinning or a ring twisting machine equipped with bobbin spindles, said bobbin exchange apparatus comprising:

a transporting belt;

a plurality of bobbin holders provided for said transporting belt and serving for taking-up bobbin tubes;

said bobbin holders being arranged at a mutual distance from one another essentially corresponding to the spindle gauge of the bobbin spindles of the machine;

said transporting belt extending in the longitudinal direction of the machine;

said transporting belt, viewed relative to the machine, being positioned at an inclination downwardly towards a front side of the machine;

supporting means provided for said bobbin tubes;

said supporting means extending substantially in the longitudinal direction of the machine; and said supporting means being positioned in front of the bobbin tubes placed upon the bobbin holders of the transporting belt and supporting said bobbin tubes.

2. The apparatus as defined in claim 1, wherein:

said supporting means comprises a rod extending in the longitudinal direction of the machine.

3. The apparatus as defined in claim 1, wherein:

said supporting means comprises a longitudinally extending, area-type element which extends in the longitudinal direction of the machine; and said element possessing a cross-section which is of substantially curved configuration.

4. The apparatus as defined in claim 1, further including:

a guide element which guides the transporting belt and to which there is secured said supporting means.

5. The apparatus as defined in claim 1, further including:

means defining a duct having a front wall;

said duct serving for receiving therein bobbins and bobbin tubes and containing therein said transporting belt; and said supporting means being secured to said front wall of said duct.

6. The apparatus as defined in claim 1, wherein:

said supporting means forms a front wall of a duct for bobbins and bobbin tubes and in which there is arranged the transporting belt.

7. The apparatus as defined in claim 1, wherein:

said supporting means contain a low friction surface at least at points thereof where the bobbin tubes come into contact with said supporting means.

8. The apparatus as defined in claim 1, wherein:

said inclined transporting band is located beneath and substantially in alignment with the bobbin spindles.

9. The apparatus as defined in claim 1, wherein:

said inclined transporting band is located beneath said bobbin spindles and is intersected by a substantially vertically extending plane passing through the bobbin spindles.

10. The apparatus as defined in claim 1, further including:

a spindle rail of substantially U-shaped cross-sectional configuration for supporting the bobbin spindles.

11. The apparatus as defined in claim 10, wherein:

each of said bobbin spindles contains a relatively long spindle bearing.

12. The apparatus as defined in claim 11, wherein:

said U-shaped spindle rail has substantially horizontally extending leg members; and said relatively long spindle bearings being straddled by said horizontally extending leg members.

13. The apparatus as defined in claim 1, further including:

a spindle rail for supporting the bobbin spindle; and the spacing between said transporting belt and said spindle rail being less than the height of the bobbin tubes supported by said bobbin holders.

* * * * *